US005570588A

United States Patent [19]

Lowe

[11] Patent Number: 5,570,588

[45] Date of Patent: Nov. 5, 1996

[54] FREEZABLE INSERT COOLER

[76] Inventor: Scott A. Lowe, 34 Southeast Ave., Baltimore, Md. 21224

[21] Appl. No.: 494,834

[22] Filed: Jun. 26, 1995

[51] Int. Cl.[6] ..... F25D 3/08

[52] U.S. Cl. ..... 62/457.7; 62/530

[58] Field of Search ..... 62/457.2, 457.7, 62/530; 220/334, 429–431

[56] References Cited

U.S. PATENT DOCUMENTS

| | | | |
|---|---|---|---|
| 2,781,643 | 2/1957 | Fairweather | 62/530 X |
| 2,783,195 | 2/1957 | Raynes et al. | 220/429 X |
| 2,945,361 | 7/1960 | Miller | 220/431 X |
| 3,187,518 | 6/1965 | Bair et al. | 62/457.7 X |
| 4,293,079 | 10/1981 | Lytle | 220/334 X |
| 4,498,312 | 2/1985 | Schlosser | 62/530 X |
| 4,830,190 | 5/1989 | Inagaki | 62/457.7 X |
| 5,231,850 | 8/1993 | Morris | 62/457.7 X |
| 5,390,797 | 2/1995 | Smalley et al. | 62/457.7 X |
| 5,462,213 | 10/1995 | Watt | 62/457.7 X |

*Primary Examiner*—William E. Tapoical

[57] ABSTRACT

A cooler for maintaining objects at a desired temperature. The inventive device includes a cooler body having a hollow perimeter sidewall. A gel-pack insert is removably positioned within the hollow perimeter sidewall and a removable upper rim closure seals the gel-pack insert therewithin. A lid is pivotally mounted to the upper rim closure and operates to enclose objects within the cooler body, whereby the gel-pack insert maintains the objects within the cooler at a desired temperature.

8 Claims, 3 Drawing Sheets

FREEZABLE INSERT COOLER

BACKGROUND OF THE INVENTION

1. Field of the Invention

The present invention relates to cooler structures and more particularly pertains to a freezable insert cooler for maintaining objects at a desired temperature.

2. Description of the Prior Art

The use of cooler structures is known in the prior art. More specifically, cooler structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art cooler structures include U.S. Pat. No. 5,231,850; U.S. Pat. No. 5,216,900; U.S. Pat. No. 4,981,234; U.S. Pat. No. 5,050,387; U.S. Pat. No. 4,651,538; U.S. Pat. No. 5,050,766; and U.S. Pat. No. 5,275,015.

While these devices fulfill their respective, particular objectives and requirements, the aforementioned patents do not disclose a freezable insert cooler for maintaining objects at a desired temperature which includes a cooler body having a hollow perimeter sidewall, a gel-pack insert removably positioned within the hollow perimeter sidewall, a removable upper rim closure sealing the gel-pack insert within the hollow perimeter sidewall, and a lid pivotally mounted to the upper rim closure operating to enclose objects within the cooler body, whereby the gel-pack insert maintains the objects within the cooler at a desired temperature.

In these respects, the freezable insert cooler according to the present invention substantially departs from the conventional concepts and designs of the prior art, and in so doing provides an apparatus primarily developed for the purpose of maintaining objects at a desired temperature.

SUMMARY OF THE INVENTION

In view of the foregoing disadvantages inherent in the known types of cooler structures now present in the prior art, the present invention provides a new freezable insert cooler construction wherein the same can be utilized for maintaining objects at a desired temperature. As such, the general purpose of the present invention, which will be described subsequently in greater detail, is to provide a new freezable insert cooler apparatus and method which has many of the advantages of the cooler structures mentioned heretofore and many novel features that result in a freezable insert cooler which is not anticipated, rendered obvious, suggested, or even implied by any of the prior art cooler structures, either alone or in any combination thereof.

To attain this, the present invention generally comprises a cooler for maintaining objects at a desired temperature. The inventive device includes a cooler body having a hollow perimeter sidewall. A gel-pack insert is removably positioned within the hollow perimeter sidewall and a removable upper rim closure seals the gel-pack insert therewithin. A lid is pivotally mounted to the upper rim closure and operates to enclose objects within the cooler body, whereby the gel-pack insert maintains the objects within the cooler at a desired temperature.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new freezable insert cooler apparatus and method which has many of the advantages of the cooler structures mentioned heretofore and many novel features that result in a freezable insert cooler which is not anticipated, rendered obvious, suggested, or even implied by any of the prior art cooler structures, either alone or in any combination thereof.

It is another object of the present invention to provide a new freezable insert cooler which may be easily and efficiently manufactured and marketed.

It is a further object of the present invention to provide a new freezable insert cooler which is of a durable and reliable construction.

An even further object of the present invention is to provide a new freezable insert cooler which is susceptible of a low cost of manufacture with regard to both materials and labor, and which accordingly is then susceptible of low prices of sale to the consuming public, thereby making such freezable insert coolers economically available to the buying public.

Still yet another object of the present invention is to provide a new freezable insert cooler which provides in the apparatuses and methods of the prior art some of the advantages thereof, while simultaneously overcoming some of the disadvantages normally associated therewith.

Still another object of the present invention is to provide a new freezable insert cooler for maintaining objects at a desired temperature.

Yet another object of the present invention is to provide a new freezable insert cooler which includes a cooler body having a hollow perimeter sidewall, a gel-pack insert removably positioned within the hollow perimeter sidewall, a removable upper rim closure sealing the gel-pack insert within the hollow perimeter sidewall, and a lid pivotally mounted to the upper rim closure operating to enclose objects within the cooler body, whereby the gel-pack insert maintains the objects within the cooler at a desired temperature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
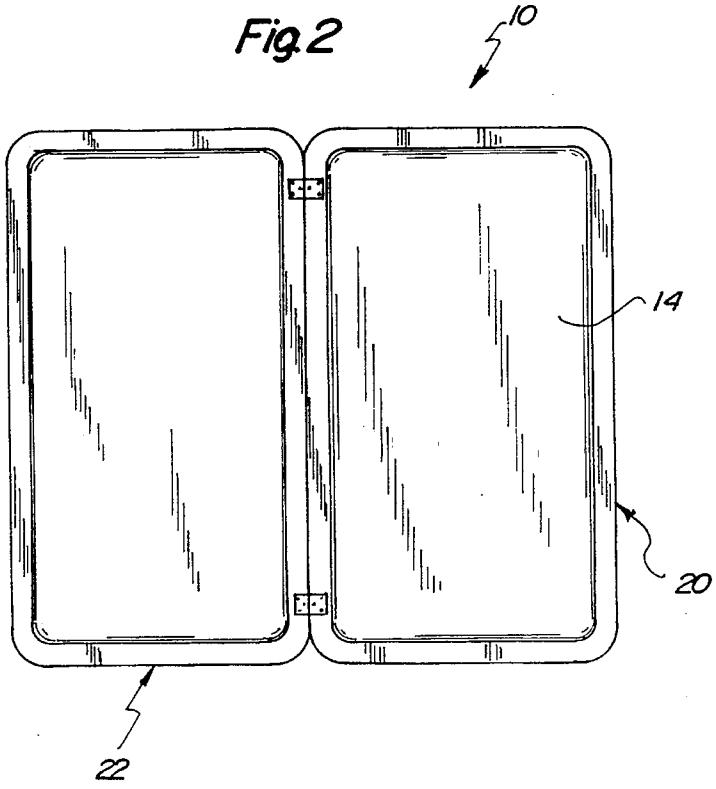
FIG. 2 is a top plan view of the invention taken from line 2—2 of FIG. 1.

With reference now to the drawings, and in particular to FIGS. 1–6 thereof, a new freezable insert cooler embodying the principles and concepts of the present invention and generally designated by the reference numeral 10 will be described.

Figure 1:
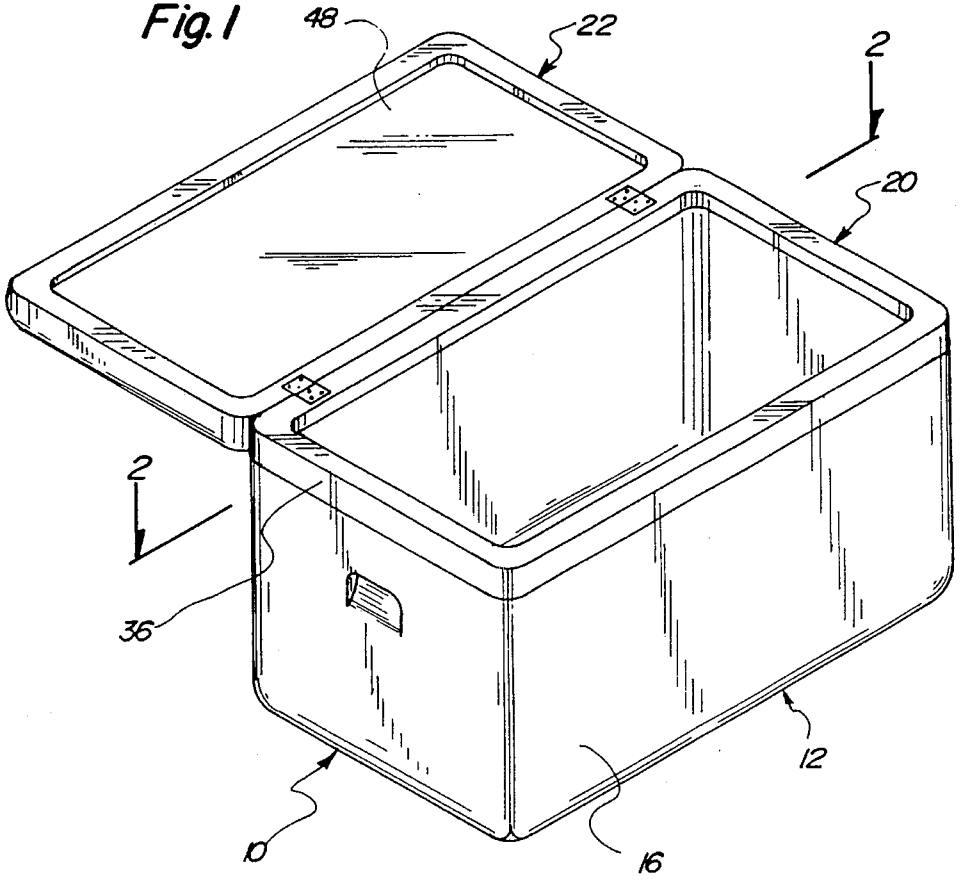
FIG. 1 is an isometric illustration of a freezable insert cooler according to the present invention.
Figure 3:
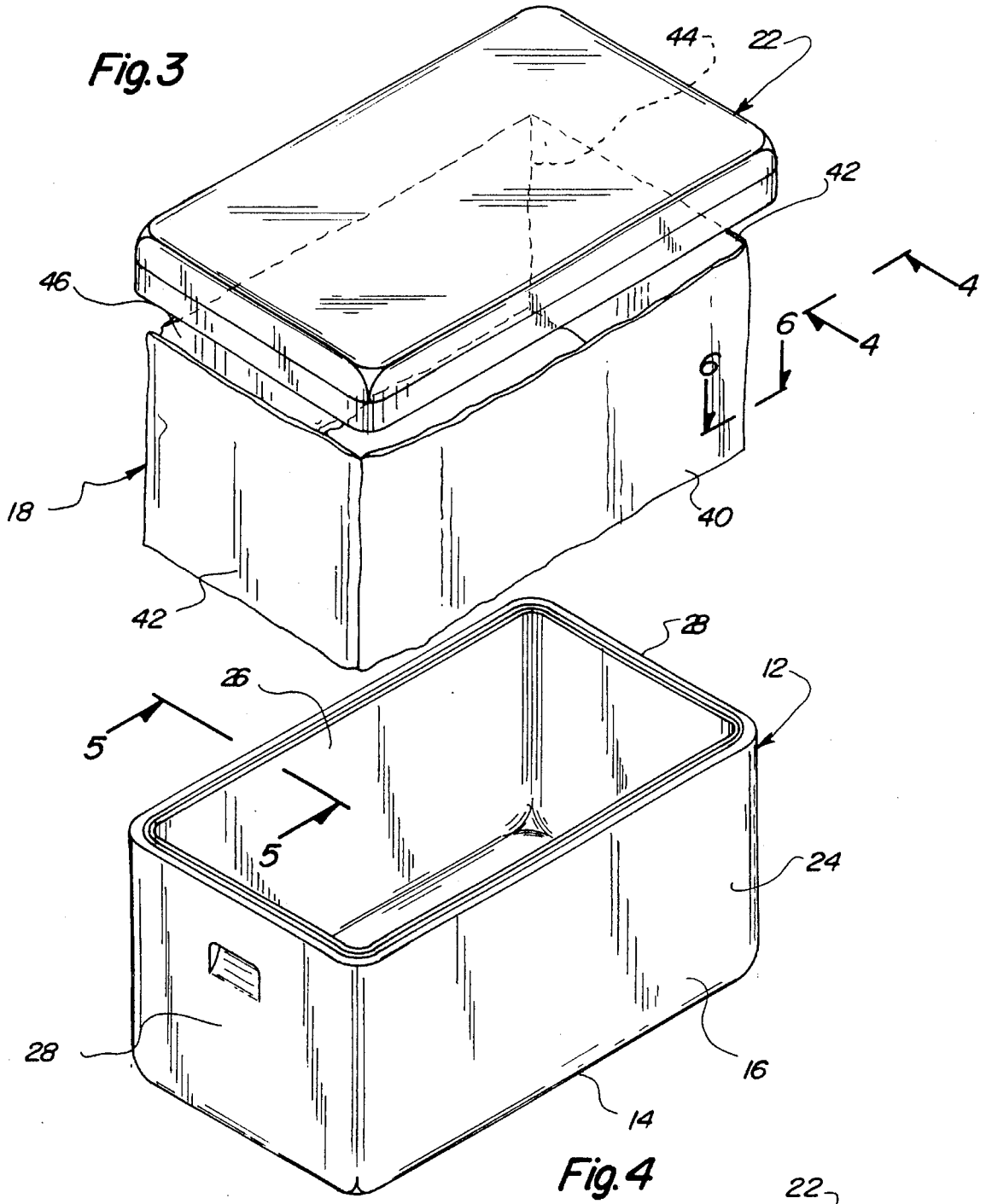
FIG. 3 is an exploded isometric illustration of the invention.

More specifically, it will be noted that the freezable insert cooler 10 comprises a cooler body 12 of substantially rectangular configuration and including a bottom wall 14 having a hollow perimeter sidewall 16 projecting substantially orthogonally upwardly from an outer periphery of the bottom wall 14, as shown in FIGS. 1 and 3 of the drawings. A gel-pack insert 18 is removably positioned within the hollow perimeter sidewall 16. An upper rim closure 20 is removably secured to an upper edge of the perimeter sidewall 16 so as to extend coextensively therearound to enclose the gel-pack insert 18 within the hollow perimeter sidewall 16. A lid 22 is pivotally mounted to the upper rim closure 20 and operates to enclose objects within the hollow interior of the cooler body 12 whereby such objects will be maintained at a desired temperature by the gel-pack insert 18 contained within the hollow perimeter sidewall 16 thereof.

Figure 5:
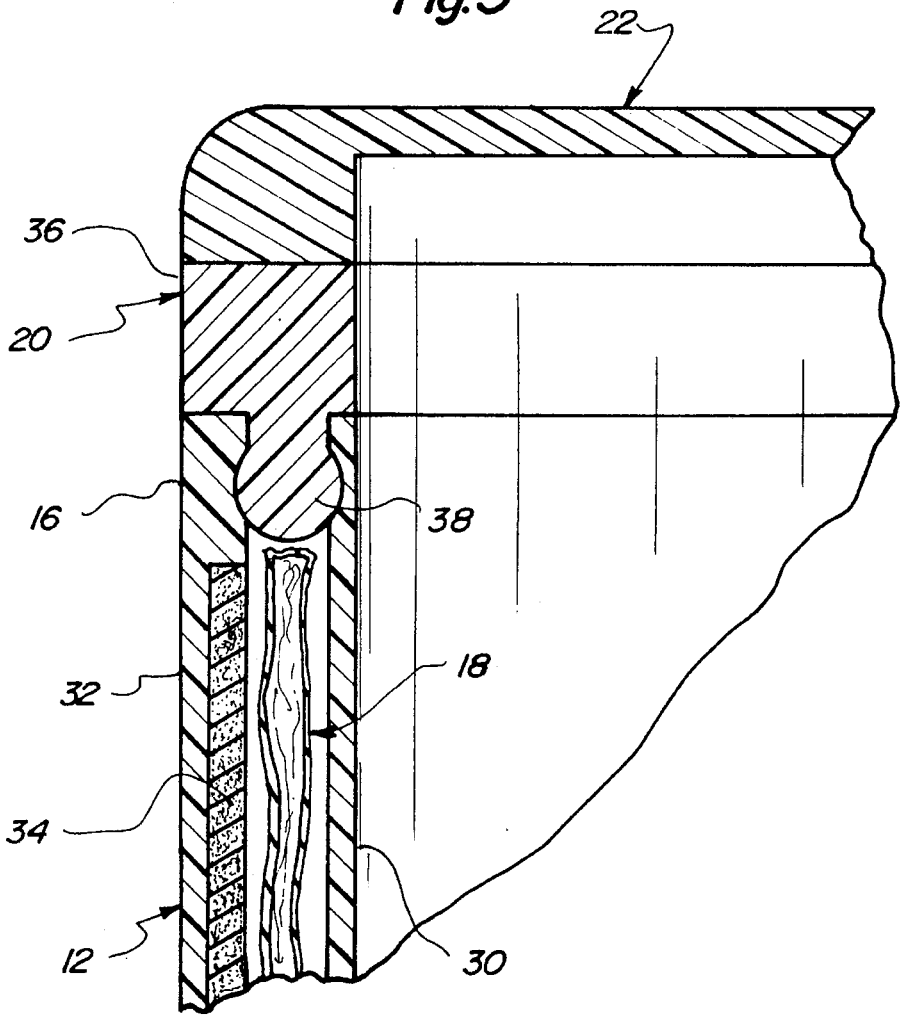
FIG. 5 is a cross-sectional view taken along line 5—5 of FIG. 3.

As best illustrated in FIG. 3, it can be shown that the hollow perimeter sidewall 16 of the cooler body 12 preferably comprises a front wall 24 projecting substantially orthogonally from a front longitudinal edge of the bottom wall 14. A rear wall 26 projects substantially orthogonally from a rear longitudinal edge of the bottom wall 14 and into a substantially spaced and parallel orientation relative to the front wall 24. Lateral walls 28 extend substantially orthogonally between the front wall 24 and the rear wall 26 at opposed transverse edges of the bottom wall 14 so as to define a substantially rectangular shape of the cooler body 12. The walls 24–28 are integrally connected together such that a hollow interior of the hollow perimeter sidewall 16 extends continuously through the perimeter sidewall 16. As shown in FIG. 5, each of the walls 24–28 comprises an interior wall 30 spaced from an exterior wall 32 so as to define a substantially hollow interior of the perimeter sidewall 16. Insulation 34 is advantageously secured to an interior surface of the exterior wall 32 and spaced from the interior wall 30 so as to insulate the hollow interior of the perimeter sidewall 16 from an exterior of the cooler body 12. The gel-pack insert 18 is thus operable to be positioned within the hollow interior of the perimeter sidewall 16 and extend in a continuous manner through the hollow interiors of the walls 24–28.

Figure 4:
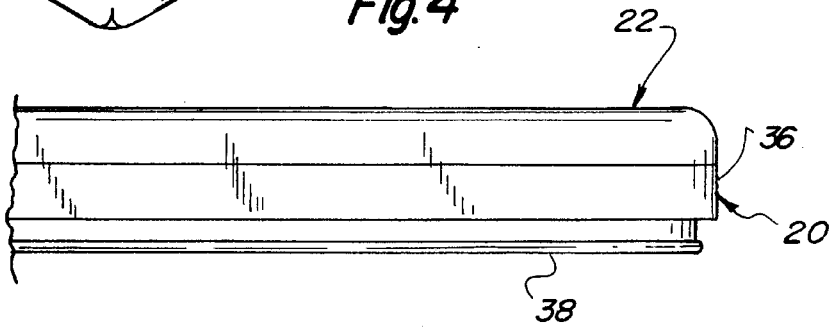
FIG. 4 is an enlarged elevation view of a portion of the present invention taken from line 4—4 of FIG. 3.

As best illustrated in FIGS. 4 and 5, it can be shown that the upper rim closure 20 of the present invention 10 preferably comprises a substantially rectangular rim frame 36 positionable on top of the perimeter sidewall 16 so as to coextensively cover an upper edge thereof. A circumferential projection 38 depends from a lower edge of the rim frame 36 and is adapted for positioning into the hollow interior of the perimeter sidewall 16 so as to frictionally retain the rim frame 36 relative to the perimeter sidewall 16 to couple the upper rim closure 20 to the cooler body 12. By this structure, the upper rim closure 20 can be easily coupled and decoupled relative to the cooler body 12 so as to permit positioning or removal of the gel-pack insert 18 from the hollow perimeter sidewall 16.

Figure 6:
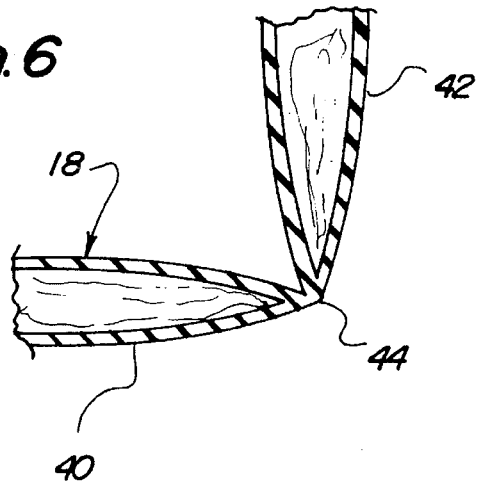
FIG. 6 is a cross-sectional view taken along line 6—6 of FIG. 3.

Referring now to FIGS. 3 and 6, it can be shown that the gel-pack insert 18 of the present invention 10 includes a front gel-pack 40 shaped so as to be positionable within the hollow interior of the front wall 24 of the perimeter sidewall 16. Lateral gel-packs 42 extend from respectively opposed vertical edges of the front gel-pack 40 as illustrated in FIG. 3 and are shaped so as to be positionable within the hollow interior of the lateral walls 28 of the hollow perimeter sidewalls 16. As shown in FIG. 6 or 1 of the lateral gel-packs 42, the lateral gel-packs 42 are advantageously coupled to the opposed vertical edges of the front gel-pack 40 by an integral hinge 44. In a similar manner, a rear gel-pack 46 is pivotally coupled to a vertical edge of one of the lateral gel-packs 42 by another integral hinge 44. It is desirable that a vertical edge of one of the lateral gel-packs 42 be separated from a vertical edge of one of the rear gel-packs 46 so as to permit folding of the device during storage and/or freezing thereof. Each of the gel-packs 40, 42, and 46 of the gel-pack insert 18 includes an unlabelled thermal gel positioned therein of conventionally known composition which operates to retain or absorb heat in response to a thermal differential. By this structure, the gel-pack insert 18 can be selectively cooled, frozen, or heated, so as to maintain an interior of the cooler body 12 of the device 10 at a desired temperature when the device is assembled as shown in FIG. 1 of the drawings with the gel-pack insert 18 positioned within the hollow perimeter sidewall 16 of the cooler body 12. Preferably, the gel-pack insert 18 is constructed of an unlabelled exterior web of flexible and water impervious construction coupled to an unlabelled interior web. The webs of the gel-pack insert 18 are preferably heat sealed together as shown in FIG. 6 so as to create upper and lower sealed edges thereof as well as the integral hinges 44 extending between the gel-packs 40, 42, and 46.

As best shown in FIGS. 1 and 2, it can be shown that the lid 22 coupled to the upper rim closure 20 preferably comprises a substantially planar lid member 48 which is pivotally mounted to the rim frame 36 of the upper rim closure 20. The planar lid member 48 is dimensioned so as to coextensively extend across an open upper end of the cooler body 12 and may include insulation or like materials precluding thermal transfer of heat thereacross.

In use, the freezable insert cooler 10 according to the present invention can be easily utilized to effect storage and maintenance of objects at a desired temperature. The freezable gel-pack insert 18 can be selectively removed from the hollow perimeter side wall 16 of the cooler body 12 and positioned into a heated or cooled environment, whereby repositioning of the gel-pack insert into the hollow perimeter sidewall 16 will cause an interior of the cooler body 12 be maintained at such desired temperature.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A freezable insert cooler comprising:

a cooler body including a bottom wall and a hollow perimeter sidewall projecting substantially upwardly from an outer periphery of the bottom wall;

a gel-pack insert removably positioned within the hollow perimeter sidewall;

an upper rim closure removably secured to an upper edge of the perimeter sidewall so as to extend coextensively therearound to enclose the gel-pack insert within the hollow perimeter sidewall;

a lid pivotally mounted to the upper rim closure.

2. The freezable insert cooler of claim 1, wherein the hollow perimeter sidewall comprises a front wall projecting substantially orthogonally from a front longitudinal edge of the bottom wall; a rear wall projecting substantially orthogonally from a rear longitudinal edge of the bottom wall and into a substantially spaced and parallel orientation relative to the front wall; and lateral walls extending substantially orthogonally between the front wall and the rear wall at opposed transverse edges of the bottom wall so as to define a substantially rectangular shape of the cooler body.

3. The freezable insert cooler of claim 2, wherein the walls are integrally connected together such that a hollow interior of the hollow perimeter sidewall extends continuously through the perimeter sidewall.

4. The freezable insert cooler of claim 3, wherein each of the walls comprises an interior wall spaced from an exterior wall so as to define a substantially hollow interior of the perimeter sidewall, with insulation secured to an interior surface of the exterior wall and spaced from the interior wall so as to insulate the hollow interior of the perimeter sidewall from an exterior of the cooler body, the gel-pack insert being positioned within the hollow interior of the perimeter sidewall and extending in a continuous manner through the hollow interiors of the walls.

5. The freezable insert cooler of claim 4, wherein the upper rim closure comprises a substantially rectangular rim frame positionable on top of the perimeter sidewall so as to coextensively cover an upper edge thereof; and a circumferential projection depending from a lower edge of the rim frame and being positioned into the hollow interior of the perimeter sidewall so as to frictionally retain the rim frame relative to the perimeter sidewall to couple the upper rim closure to the cooler body.

6. The freezable insert cooler of claim 5, wherein the gel-pack insert includes a front gel-pack shaped so as to be positionable within a hollow interior of the front wall of the perimeter sidewall; lateral gel-packs pivotally coupled to respectively opposed vertical edges of the front gel-pack, the lateral gel-packs being shaped so as to be positionable within respective hollow interiors of the respective lateral walls of the perimeter sidewall; a rear gel-pack pivotally coupled to a vertical edge of one of the lateral gel-packs, the rear gel-pack being shaped so as to be positionable within a hollow interior of the rear wall of the perimeter sidewall.

7. The freezable insert cooler of claim 6, wherein the gel-pack insert is constructed of an exterior web of flexible and water impervious construction coupled to an interior web, the webs of the gel-pack insert being sealed together so as to create upper and lower sealed edges thereof as well as integral hinges extending between the gel-packs.

8. The freezable insert cooler of claim 7, wherein the lid coupled to the upper rim closure comprises a substantially planar lid member pivotally mounted to the rim frame of the upper rim closure.

* * * * *